US007921863B2

(12) United States Patent
Ways

(10) Patent No.: US 7,921,863 B2
(45) Date of Patent: Apr. 12, 2011

(54) SELF-SUPPORTING, HIGH-PROFILE, INSECT NET ENCLOSURE

(76) Inventor: David Edward Ways, Bradenton, FL (US)

( * ) Notice: Subject to any disclaimer, the term of this patent is extended or adjusted under 35 U.S.C. 154(b) by 13 days.

(21) Appl. No.: 12/210,605

(22) Filed: Sep. 15, 2008

(65) Prior Publication Data

US 2010/0065094 A1 Mar. 18, 2010

(51) Int. Cl.
*E04H 15/40* (2006.01)

(52) U.S. Cl. ..... 135/125; 135/127; 135/138

(58) Field of Classification Search ..... 135/123, 135/124, 125, 127, 138, 157, 913, 121, 906, 135/907, 87, 161; 5/113
See application file for complete search history.

(56) References Cited

U.S. PATENT DOCUMENTS

| | | | | |
|---|---|---|---|---|
| 364,415 | A | 6/1887 | Hooper | |
| 607,933 | A * | 7/1898 | Laird | 135/125 |
| 800,530 | A | 9/1905 | Young | |
| 1,728,356 | A * | 9/1929 | Morgan | 135/154 |
| 2,301,511 | A | 1/1942 | Boyce | |
| 2,841,803 | A | 8/1955 | Bodling | |
| 3,028,871 | A * | 4/1962 | Clift, Jr. | 135/130 |
| 3,800,814 | A * | 4/1974 | Hibbert | 135/93 |
| 3,874,398 | A * | 4/1975 | Hendrickson | 135/144 |
| 4,236,543 | A | 12/1980 | Moss | |
| 4,590,956 | A * | 5/1986 | Griesenbeck | 135/116 |
| 4,723,371 | A * | 2/1988 | Williams | 43/1 |
| 4,819,680 | A * | 4/1989 | Beavers | 135/125 |
| 4,858,635 | A * | 8/1989 | Eppenbach | 135/125 |
| 4,926,893 | A * | 5/1990 | Klopfenstein et al. | 135/157 |
| 5,010,909 | A * | 4/1991 | Cleveland | 135/125 |
| 6,517,444 | B1 * | 2/2003 | Yoon | 473/197 |
| 6,672,323 | B2 | 1/2004 | Gupta | |
| 6,715,168 | B2 | 4/2004 | Williams | |
| 6,896,892 | B2 * | 5/2005 | Mount et al. | 424/411 |

* cited by examiner

*Primary Examiner* — David Dunn
*Assistant Examiner* — Noah Chandler Hawk

(57) ABSTRACT

A self-supporting, high-profile, insect net enclosure made of a fabric membrane that defines an interior rectangular space having two side walls, two end walls, a floor and ceiling with advanced insect protection properties, enhanced comfort, accessibility, ventilation, and lightweight storage characteristics, includes two resiliently flexible segmented poles having two angles each that separate three straight pole sections into one horizontal section and two vertical sections.

The enclosure maintains a stable shape as the fabric membrane is pushed out by the poles contained within the interior rectangular space that are biased in place by the fabric membrane when the pole ends are positioned in opposite lower inside corners, with the vertical pole sections crossing diagonally, and the horizontal pole sections parallel to each other along top of side walls.

The enclosure has a zipper door opening, and includes a fabric pouch that reverses to store the enclosure with poles for transportation.

20 Claims, 2 Drawing Sheets

SELF-SUPPORTING, HIGH-PROFILE, INSECT NET ENCLOSURE

FIELD OF THE INVENTION

The present invention relates generally to a portable, lightweight, self-supporting, tent-like, insect net enclosure. In particular the invention relates to a multi-purpose, self-supporting, high-profile, long-lasting insecticide treated insect net enclosure which has advanced insect protection properties and which is specifically adapted for use in both military medical field hospital operations and other applications in which protection from insects is desired. In preferred embodiments of the invention, components are adapted to provide multiple functions whereby the invention is particularly adapted for military medical field hospital applications.

BACKGROUND OF THE INVENTION

This present invention improves upon several aspects of a class of canopies to protect a person from mosquitoes and other insects, using a mosquito net or other similar fabric to cover beds, cots, and the like, including their framework or supporting mechanism.

Typical canopy supports of the art are disclosed in U.S. Pat. Nos. 364,415; 800,530; 2,301,511; 2,841,803; and 6,715,168. Some type of suitable netting material is typically supported by a rigid frame. The patent by Hooper ('415) illustrates netting for a bed supported by four columns having bands or cords extending between columns to support the netting. The columns are held in place by feet inserted beneath the legs of the bed.

The Young patent ('530) discloses a rigid frame supporting a canopy. The posts are secured to the ends of the cot legs and rings connected to the side bars prevent the posts from falling away. Upper canopy side bars are removable and secured to the upper end of the posts on each side to properly stretch and hold in place the canopy material. The rigid frame remains attached to the cot when the cot is folded.

The Boyce patent ('511) discloses a mosquito bar rigid frame support at each end of a conventional army cot comprising vertical supporting rods each held in place by an upper supporting loop around the frame of the cot and a base loop around the lower end of a supporting leg. The top of the supporting rods have telescoping sleeves to receive a cross-bar. The insect bar is stretched from one end assembly to the other end assembly and secured by tying the fabric to the cot.

The Bodling patent ('803) is a tent constructed over a cot by providing a rigid frame located lengthwise above the center of the cot. Uprights at each end have pins at their lower ends adapted to be secured in vertical holes formed in the end rails of the cot. A hinged ridge pole at the top of the uprights provides support for the netting between the ridge pole and the lateral edges of the cot, similar to a pup-tent.

The Williams patent (168) discloses a rectangular rigid frame of a plurality of square tubes that form side members along the length and cross members across the width of the top frame. A pair of T-shaped center fittings are provided for connecting a pair of the square tube side members near the center of the length of the top frame and connecting one square tube cross member extending across the width of the top frame. Double square corner fittings are provided for connecting the square tube side members to square tube cross members at each corner of the top frame.

Typical portable tents of the art are disclosed in U.S. Pat. Nos. 4,236,543; and 6,672,323. Although these tent structures utilize a flexible support system, they are different from the current invention, in that the flexible supports are either attached to the peripheral portions, or they are permanently affixed to the tent.

The Moss patent ('543) is a portable tent, comprising a flexible covering held tense to provide the shape of the shelter by two resiliently flexible pole members held in a flexed condition by peripheral portions of said side walls, each said pole member having the end portions thereof held respectively by front and rear peripheral portions of the same side wall to hold the pole member in an inverted generally U-shape, tensing said side walls horizontally and the central portion thereof held by the upper peripheral portion of the other side wall to hold the pole member in a bowed shape.

The Gupta patent ('323) is a self-erecting structure having resilient lower and upper support loops which provide it with shape and support. Fabric covers the support loops, and is permanently affixed to the support loops.

Due to the critical importance to provide military personnel protection against insect-borne diseases, the U.S. military currently issues several types of bednets. The standard insect net protector, (NSN 7210-00-266-9736), and (NSN 7210-01-520-7136) and the insect bar (NSN 7210-00-266-9740). These bednets have a variety of limitations associated with them, such as not being impregnated with a repellent, requiring four 36" rigid poles to set-up, difficult to access, and not having a floor to be fully enclosed.

The Self-Supporting Low-Profile (SS-LP) bednet (NSN 3740-01-516-4415 [woodland green] and NSN 3740-01-518-7310 [coyote brown]) eliminates most of the limitations associated with the previously mentioned standard bednets. Based upon U.S. Pat. No. 6,672,323 by Gupta, it is a lightweight, self-contained bednet with an integral self supporting frame, that folds into a 12 inch diameter package. This bednet is intended for short-term use by rapidly deployable mobile forces (e.g., Rangers, Special Forces, Infantry, etc.), however, it is not ideal for longer-term use by less mobile occupants (e.g., medical field hospital personnel or the wounded, etc.) due to it having a low-profile that can make it feel claustrophobic.

This present invention is directed to the protection of persons in an improved net enclosure that military personnel are willing to use on a routine and long-term basis. This improved net enclosure is designed to protect against all biting insects, with a mesh size large enough to permit air flow, a lack of which is the main reason why many military personnel will not use insect bednets, as well as having a high-profile that provides ample headroom to sit-up inside on top of a standard military cot.

Accordingly, an object of the present invention is a portable and lightweight, self-supporting, high-profile, net enclosure comprised of a fabric membrane that defines an interior rectangular space having opposing side walls and opposing end walls, a floor and ceiling to be constructed of no-see-um netting, and ripstop fabric material treated with an EPA-approved long-lasting insecticide that will maintain its physical and insecticidal integrity for at least 5 years of continuous use, and not require re-treatment with insecticide after washing or prolonged exposure to direct sunlight (UV radiation).

Another object of this present invention is that it has optional tie ribbons attached to the fabric membrane along top of the opposing side walls at the ceiling on the inside of the interior rectangular space, that are constituted by a material readily able to loosen and retie to provide additional tautness to the fabric membrane.

Another object of this present invention is that it has tie loops at top four corners on its exterior are constituted by a material readily able to optionally support the net enclosure in absence of the poles.

Another object of this present invention includes a self-contained water-resistant floor making it fully enclosed with durable fabric reinforcing patches in the lower inside corners of the interior rectangular space that are made of a material to prevent puncture by the poles and by a military cot legs, if used inside.

Another object of this present invention is that a standard military cot easily fits inside, with enough headroom that the occupant can comfortably sit-up on top of the cot.

Another object of this present invention is that it has an inverted "T" zippered entrance that can be operated from inside or outside the net enclosure that releases two flaps on one side that can be folded-back and secured opened to provide full accessibility to a wounded occupant requiring medical assistance and to provide enhanced ventilation.

Another object of this present invention is that it has a sectional frame designed to allow the individual components to easily fit together as an assembled unit so the entire net enclosure can be erected in less than five minutes, and disassembled and repackaged in under five minutes.

Another object of the present invention is that the net enclosure frame uses a minimum number of different components that are interconnected so that assembly and disassembly is easily achieved without errors.

Another object of this present invention is that it has a fabric pouch sewn inside to provide secure storage for loose items, and reverses to enable net enclosure with poles to be securely and compactly packaged inside for portability.

Another object of this present invention is that it is a free-standing net enclosure with two resiliently flexible segmented poles having two angles each that separate three straight pole sections into one horizontally oriented section and two vertically oriented sections with domed end tips; durable fabric reinforcing patches in lower inside corners of the interior rectangular space. The net enclosure maintains a stable shape when the fabric membrane is pushed out by the poles that are contained within the interior rectangular space and caused to bend in a flexed condition by the fabric membrane that biases the poles in place when the poles domed end tips are positioned on the durable fabric reinforcing patches in opposing lower inside corners of the interior rectangular space, with the vertically oriented pole sections crossing diagonally at the end walls, and the horizontally oriented pole section of the poles positioned parallel to each other along top of the opposing side walls at the ceiling with the two angles of each the pole positioned in upper inside corners of the interior rectangular space; the self-supporting configuration of which is a focus of this invention.

A need exists to have a self-supporting flexible frame, to support a high-profile insect net enclosure, treated with a long-lasting insecticide to provide individualized protection from biting insects, such as mosquitoes, for wounded military personnel subject to prolong stays on cots in field hospitals, with the ability to sit-up, and other features to reduce a claustrophobic feeling. The frame should be easily assembled, lightweight, and flexible to support an insect net enclosure with good air circulation, high accessibility, to include installing a standard military cot, and an integral compact storage system.

The present invention can be utilized in many commercial, humanitarian, or disaster relief applications with equal functionality and effectiveness.

Further objects will appear from the following description taken in connection with the drawings included in and forming a part of this invention.

SUMMARY OF THE INVENTION

According to the present invention, a self-supporting, lightweight, insect net enclosure with a novel support method has been designed to provide numerous advantages over the structures and support methods heretofore known. In particular, the structure in the present invention is self-supporting by two resiliently flexible, segmented poles. While these features are described in the prior art, the preferred embodiments of the present invention employ a support mechanism whereby the inverted U-shape poles are accentuated by two angles each separate three straight pole sections into two vertically oriented sections and one horizontally oriented section equal distant from the endtips that are domed shaped and inserted in the durable fabric reinforced lower inside corners of the net enclosure.

The poles with their two angles each positioned in the upper inside corners of the fabric membrane that defines the interior rectangular space are held in a flexed state by the proportions of the interior side walls, end walls and ceiling, with the vertical portions bowed-out as the poles cross diagonally at the end walls, and horizontal portions pushing up and optionally tied in place at the midpoint along the top of the side walls with tie ribbons thereby increasing the tension to form the rectangular shape that supports the freestanding net enclosure as well as tie loops at the exterior top four corners to optionally support the net enclosure in absence of the poles.

In the preferred embodiment of the present invention, the fabrics used on the structure are treated with a long-lasting insecticide substance, and include two portions, each of which has distinct beneficial qualities, in order to optimize the utility of the structure. In particular, in the preferred embodiment of the invention the floor portion is preferably made of a ripstop nylon taffeta treated with a water-resistant substance, with durable fabric reinforcing patches in the lower inside corners to prevent puncture by the poles and by a military cot legs, if used inside, whereas the upper portion of the fabric material is a no-see-um mesh material which provides protection from the smallest insect intrusion.

Further embodiments of the present invention, is that the net enclosure has at least one three zipper door opening, one vertically the full height at the center of a side wall and two along the seam at the bottom on the same side that open in opposite directions away from the center enabling two netting panels to be folded back from the bottom center and secured with "hook and loop" fastener tabs at exterior of both end walls to maintain a triangular shape door opening. This novel feature of the door being secured open along with high-profile walls, provides ease of installation of a standard military cot, superior accessibility to wounded occupants in a medical field hospital, enhanced ventilation, and the openness required to reduce potential claustrophobic feelings during prolong use.

The present invention is further enhanced by the inclusion of an integrated fabric pouch sewn on the inside for the occupant to store personal items, that reverses for the net enclosure to fold-in with the collapsed poles for storage that includes a "hook and loop" fastener to secure closed, thus providing a novel storage method not previously known.

Preferably, the poles are each formed by a plurality of aluminum alloy segments that are detachable and inter-fitted whereby are tubular with an insert element extending from an end portion thereof and designed to fit within an end portion of the adjacent segment, the respective segments of each pole member are interconnected by an elastic "shock-cord" running through the inside. In this way, the alignment of the respective segments will be maintained while in storage or transport, and the pole segments will be held together during assembly.

DETAILED DESCRIPTION OF THE PREFERRED EMBODIMENT OF THE INVENTION

Figure 1:
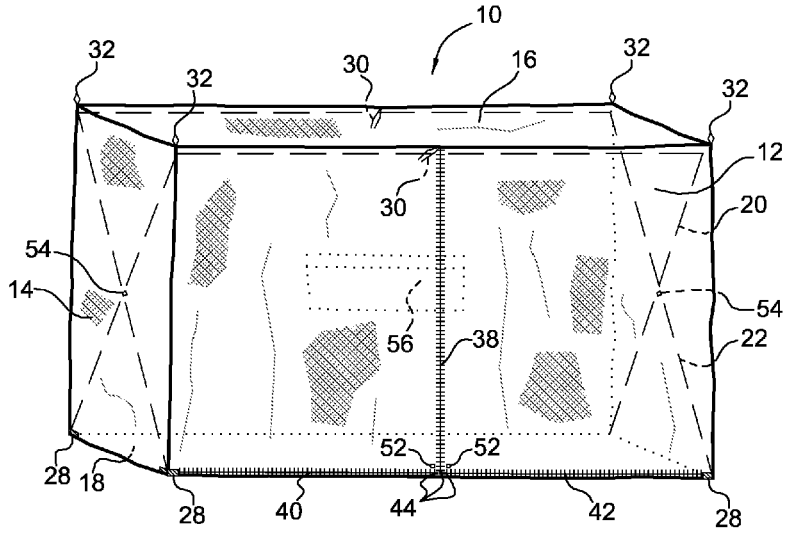
FIG. 1 is a perspective view of the front of an illustrative embodiment of the present invention showing invention in a fully closed configuration.

FIG. 1 illustrates the fully closed configuration of the self-supporting net enclosure 10 designed to accommodate a single person with enough headroom to sit-up inside on top of a military style cot, is lightweight and easily transportable making it ideal for military applications, disaster relief, humanitarian needs, as well as for recreational use.

The net enclosure 10 being impregnated with a long-lasting insecticide includes a flexible no-see-um netting fabric covering having two side walls 12, two end walls 14, and a ceiling 16; a flexible ripstop nylon taffeta floor 18, and is a self-supporting structure in that it does not require suspension lines to hold its shape or to maintain stability.

More specifically, the opposing side walls 12, opposing end walls 14, the ceiling 16 and the floor 18, hold their shape as they are pushed-out by two resiliently flexible, segmented poles 20 and 22, that have two angles each 24, held in a flexed condition by the proportions of the side walls, end walls, floor, ceiling, and poles, as each pole has a domed endtip 26, that is positioned in the reinforced corners on durable fabric reinforcing patches 28 on opposite side walls 12, the vertical portions bowed-out as the poles cross diagonally at the end walls 14, and the horizontal portions bowed-up, optionally being secured in place with optional tie ribbons 30 at the midpoint along the top of the side walls 12, thereby forming the rectangular shape that supports the freestanding net enclosure 10.

The segmented poles 20 and 22 are initially straight, having two angles each 24 that separate three straight pole sections into two vertically oriented sections and one horizontally oriented section, but are bowed-out along their vertical and horizontal portions, held in a resiliently flexed inverted U-shape position, that causes a tensing of the side walls 12 and the end walls 14, and the ceiling 16 both vertically and horizontally, and the floor 18 horizontally at the four reinforced corners on durable fabric reinforcing patches 28. Tie ribbon loops 32 sewn on the exterior of the four top corners provide an alternative "back-up" method of suspension in absence of the flexible poles.

The front side wall 12 has a door opening that includes three reversible zippers 38, 40, and 42 configured in an inverted "T", each have zipper sliders 44 operable from either inside or outside the net enclosure, and "hook" tabs 52 in the corners that allow the door flaps to be pulled back and secured to "loop" tabs 54 at the end walls. A ripstop nylon taffeta pouch 56 has a "hook and loop" fastener 58, is sewn on the inside to provide storage for the occupant's personal items and reverses to store the net enclosure 10 with poles 20 and 22 for transportation.

Figure 2:
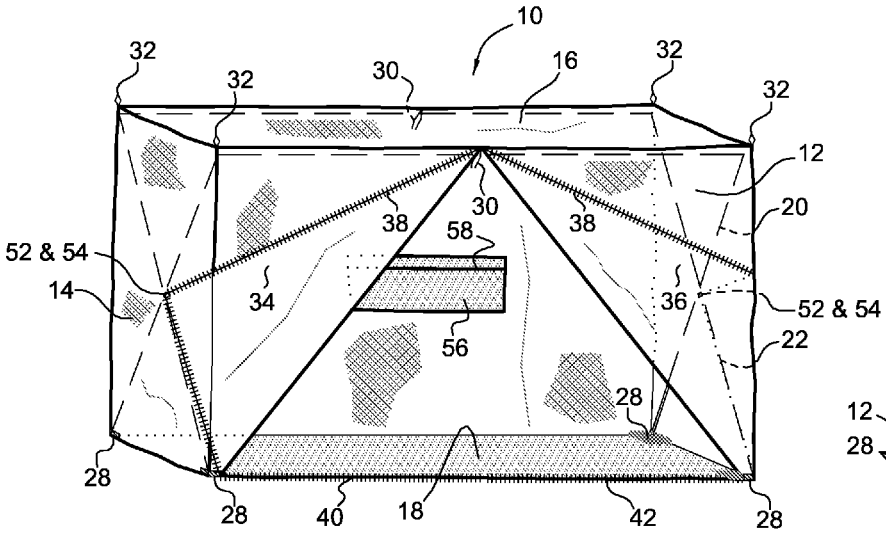
FIG. 2 is a perspective view of the front of an illustrative embodiment of the present invention showing invention in a fully open configuration.

FIG. 2 illustrates the open configuration of the self-supporting net enclosure 10 showing its front side wall 12 with the two separable door flaps 34 and 36 of netting material pulled-back and secured open to the end walls 12 with "hook and loop" tabs 52 and 54 providing full accessibility and sized to fit a standard military cot that will have its cot legs positioned on durable fabric reinforcing patches 28 to prevent puncture of floor 18.

Figure 2A:
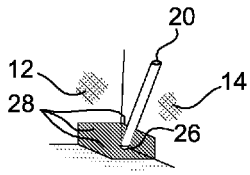
FIG. 2*a* is an enlarged view of a corner portion of the net enclosure of FIG. 2 showing a pole endtip in a reinforced corner pocket.

FIG. 2*a* is an enlarged cut away view that illustrates how one of the domed endtips 26 of the segmented poles 20 and 22 is positioned in one of the four reinforced corners on durable fabric reinforcing patches 28 of the net enclosure. In the illustrated embodiment, these reinforced corners are constituted by a heavy denier nylon fabric cut into square shapes and sewn at the four corners of the floor, and rectangular shapes sewn on the walls at the lower corners of the net enclosure 10. These two pieces form the reinforced pocket when the floor is sewn to the walls.

Figure 3:
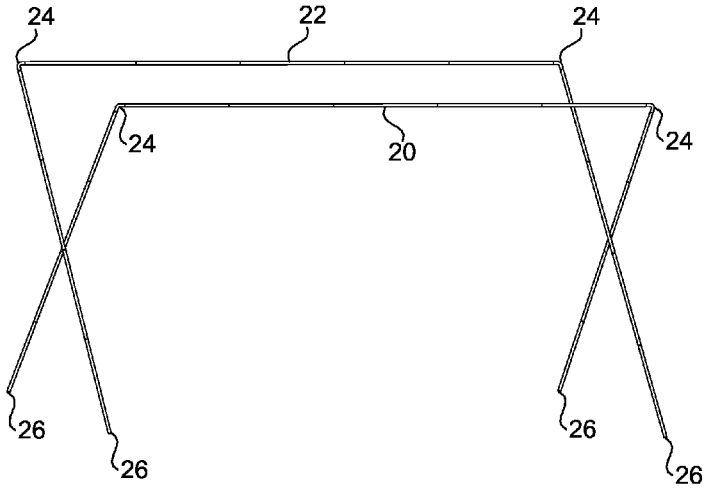
FIG. 3 is a schematic illustration of the pole members in an assembled flexed condition with the fabric portions removed of FIG. 1 and FIG. 2.

FIG. 3 illustrates a preferred construction of the segmented poles 20 and 22 in the flexed condition. The pole members are each formed by a plurality of respective segments 60, each preferably made from a resiliently flexible aluminum alloy.

Figure 4:
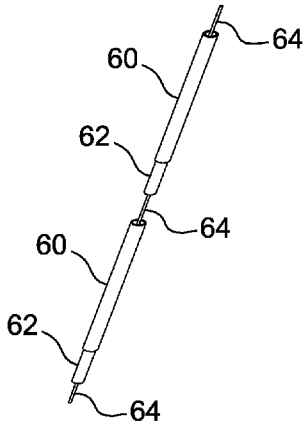
FIG. 4 is a perspective view, partly broken away, illustrating a connecting portion of the pole segments of FIG. 1 and FIG. 2.

FIG. 4 illustrates how the pole segments 60 are detachable and inter-fitted by a tubular insert portion 62 that extends from one end of respective segment and of a diameter to fit snugly within an open end portion of an adjacent segment 60. The elastic "shock-cord" 64 running through the inside of the pole members interconnects adjacent segments, pulling them together to hold securely when assembled and maintaining their respective positions when disassembled.

Figure 5:
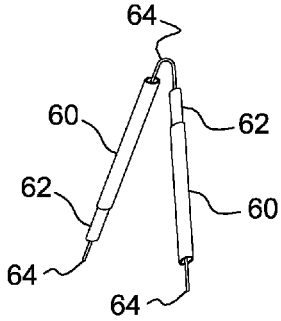
FIG. 5 is a perspective view, partly broken away, similar to FIG. 4, illustrating the interconnecting and flexible nature of the "shock-cord".

FIG. 5 illustrates how the pole segments 60 are designed to be collapsible for convenient storage and transport yet to be quickly and easily assembled.

Figure 6:
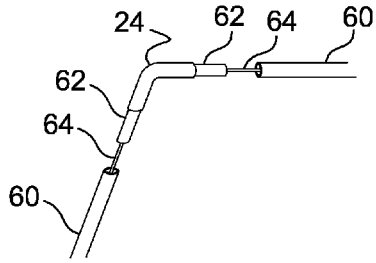
FIG. 6 is a perspective view, partly broken away, illustrating an angle connecting portion of the pole members of FIG. 1 and FIG. 2.

FIG. 6 illustrates how the angles 24 with tubular inserts 62 and the elastic "shock-cord" running through 64 connect to adjacent pole segments 60, and form the top corners of the net enclosure.

Figure 7:
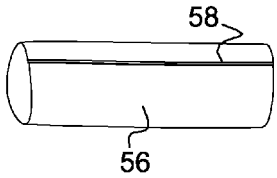
FIG. 7 is a perspective view, illustrating the storage pouch with the net enclosure and poles of FIG. 1 and FIG. 2 inside.

FIG. 7 illustrates how the ripstop nylon taffeta pouch 56 with a "hook and loop" fastener 58 conveniently and securely packages the net enclosure 10, with the poles 20 and 22 for ease of transport.

As illustrated herein, the new high-profile net enclosure structure and the novel method of support provide features not heretofore available in the known art. Specifically, the stable shape created is due to the configuration of the two poles positioned in a free-standing manner within the interior rectangular space defined by the proportions of fabric membrane as it is pushed out by the two poles that are caused to bend in a flexed condition and are biased in place by the fabric membrane. This structural dynamic alleviates the need for the "securing means" for the resilient members and the flexible sheeting material as required in prior art allowing for an increased speed and ease of deployment and disassembly.

As such the occupant can sit-up on a cot inside the net enclosure that has a zippered door that can be held open to provide full accessibility along the side, with a sewn-on storage pouch inside to store personal items, that reverses to package the net enclosure with the poles. The long-lasting insecticide treatment is not a feature of current military issued insect nets that enclose cots. Notwithstanding all of these advantages over the known apparatus, the overall spaciousness, ventilation and accessibility features provide psychological comfort needed by the occupants required to stay for long-durations under an insect net enclosure.

While the present invention has been described with reference to a particular embodiment thereof, it is to be understood, that the invention is intended to be defined and limited by the appended claims. Additionally, while a preferred embodiment of the invention has been described using specific terms, such description is for illustrative purposes only, and it is to be understood that changes and variations may be made without departing from the spirit or scope of the following claims.

What is claimed is:

1. A portable and lightweight, self-supporting, high-profile, net enclosure comprised of a fabric membrane that defines an interior rectangular space having opposing side walls and opposing end walls, a floor and ceiling; a fabric pouch attached inside said interior rectangular space; two resiliently flexible segmented poles, each pole having three straight sections and two angles, the angles separating the straight sections into two vertically oriented sections connected by a horizontally oriented section at their upper ends, wherein the lower ends of the vertically oriented sections have domed end tips; durable fabric reinforcing patches in lower inside corners of said interior rectangular space; said net enclosure maintains a stable shape when said fabric membrane is pushed out by said poles that are contained within said interior rectangular space and caused to bend in a flexed condition by said fabric membrane that biases said poles in place when said poles domed end tips are positioned on said durable fabric reinforcing patches in opposing lower inside corners of said interior rectangular space, with said vertically oriented pole sections crossing diagonally at said end walls, and said horizontally oriented pole section of said poles positioned parallel to each other along top of said opposing side walls at said ceiling with said two angles of each said pole positioned in upper inside corners of said interior rectangular space.

2. A net enclosure according to claim 1, wherein said net enclosure has tie loops at top four corners on its exterior, and further includes an inverted "T" zipper door opening on at least one said opposing side wall whereby said net enclosure may be readily accessed and provided with enhanced ventilation.

3. A net enclosure according to claim 2, wherein said tie loops at top four corners on its exterior are constituted by a material readily able to optionally support said net enclosure in absence of said poles.

4. A net enclosure according to claim 2, wherein said zipper door opening is constituted of three reversible zippers, has one vertical zipper the full height at the center of at least one said side wall and two horizontal zippers along the seam at the bottom on the same side that open in opposite directions away from the center in an inverted "T" configuration.

5. A net enclosure according to claim 4, wherein said zipper door opening is constituted of two fabric panels that can be folded back from bottom center and secured in an opened position with hook and loop fastener tabs attached on said opposing end walls exteriors to maintain a triangular shape door opening and provide enhanced ventilation.

6. A net enclosure according to claim 5, wherein said triangular shape door opening is sized to easily insert a military cot, and provide access to a wounded occupant requiring medical assistance.

7. A net enclosure according to claim 1, wherein said opposing side walls, opposing end walls, and ceiling are constituted by netting that is substantially impermeable to insects.

8. A net enclosure according to claim 1, wherein said opposing side walls, opposing end walls, and ceiling are constituted by netting that is treated with a long-lasting insect-repellent substance.

9. A net enclosure according to claim 1, wherein said floor and said pouch are constituted by a water resistant material.

10. A net enclosure according to claim 1, wherein said floor and said pouch are constituted by a water resistant material treated with a water repellant substance.

11. A net enclosure according to claim 1, wherein said floor and said pouch are constituted by a water resistant material treated with a long-lasting insect repellent substance.

12. A net enclosure according to claim 1, wherein said durable fabric reinforcing patches in said lower inside corners of said interior rectangular space are constituted by a material to prevent puncture by said poles and said floor has durable fabric reinforcing patches to prevent puncture by a military cot legs, if used inside.

13. A net enclosure according to claim 1, said interior rectangular space is sized to accommodate a military cot used in a field hospital, with headroom inside said interior rectangular space to allow an occupant to comfortably sit up on said cot.

14. A net enclosure according to claim 1, wherein said net enclosure has optional tie ribbons attached to said fabric membrane along top of said opposing side walls at said ceiling on the inside of said interior rectangular space, that are constituted by a material readily able to loosen and retie to provide additional tautness to said fabric membrane.

15. A net enclosure according to claim 1, wherein said two resiliently flexible segmented poles are biased in place in an inverted generally U-shape flexed condition by their proportions relative to said fabric membrane proportions of said interior rectangular space.

16. A net enclosure according to claim 15, wherein said poles are each formed by a plurality of pole segments that are inter-fitted and detachable.

17. A net enclosure according to claim 16, each of said pole segments are tubular with an insert element extending from an end portion thereof and designed to fit within an end portion of the adjacent pole segment.

18. A net enclosure according to claim 17, wherein said pole segments are preferably formed from an aluminum alloy.

19. A net enclosure according to claim 17, wherein said insert elements are tubular, the respective said pole segments are interconnected by an elastic "shock-cord" running through the inside of each said pole.

20. A net enclosure according to claim 1, wherein said pouch is sewn inside said net enclosure, reversible and sized to fit said net enclosure inside with said poles to store, and has a hook and loop fastener to secure closed.

* * * * *